US007013971B2

(12) United States Patent
Griffith et al.

(10) Patent No.: US 7,013,971 B2
(45) Date of Patent: Mar. 21, 2006

(54) REVERSE CIRCULATION CEMENTING PROCESS

(75) Inventors: James E. Griffith, Loco, OK (US); Timothy W. Marriott, Medicine Hat (CA); Edgar J. Liegis, Medicine Hat (CA); Randy D. Humphrey, Medicine Hat (CA); John L. Dennis, Jr., Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 97 days.

(21) Appl. No.: 10/442,442

(22) Filed: May 21, 2003

(65) Prior Publication Data

US 2004/0231846 A1 Nov. 25, 2004

(51) Int. Cl.
*E21B 47/00* (2006.01)

(52) U.S. Cl. ..... 166/250.14; 166/285; 166/291

(58) Field of Classification Search ..... 166/285, 166/250.14, 291, 292, 177.4
See application file for complete search history.

(56) References Cited

U.S. PATENT DOCUMENTS

| | | | | |
|---|---|---|---|---|
| 2,647,727 A | | 8/1953 | Edwards | 255/28 |
| 2,675,082 A | | 4/1954 | Hall | 166/22 |
| 2,919,709 A | | 1/1960 | Schwegman | 137/68 |
| 3,051,246 A | | 8/1962 | Clark, Jr. et al. | 166/226 |
| 3,277,962 A | | 10/1966 | Flickinger et al. | 166/15 |
| 3,624,018 A | * | 11/1971 | Eilers et al. | 524/377 |
| 3,653,441 A | * | 4/1972 | Tuttle | 166/291 |
| 3,948,322 A | | 4/1976 | Baker | 166/289 |
| 3,951,208 A | | 4/1976 | Delano | 166/78 |
| 4,105,069 A | | 8/1978 | Baker | 166/51 |
| 4,466,833 A | * | 8/1984 | Spangle | 106/602 |
| 4,548,271 A | | 10/1985 | Keller | 166/291 |
| 5,024,273 A | | 6/1991 | Coone et al. | 166/289 |

(Continued)

FOREIGN PATENT DOCUMENTS

EP 0 419 281 A2 3/1991

(Continued)

OTHER PUBLICATIONS

SPE 25540 entitled "Evaluation of the Effects of Multiples In Seismic Data From the Gulf Using Vertical Seismic Profiles" by Andrew Fryer, dated 1993.

(Continued)

*Primary Examiner*—William Neuder
(74) *Attorney, Agent, or Firm*—John W. Wustenberg; Baker Botts L.L.P.

(57) ABSTRACT

A method of cementing a casing in a wellbore with a tool having a plurality of holes therethrough connected at a lower end of the casing. The total cross-sectional area of the holes is preferably greater than the cross-sectional area of the inside of the casing. A plurality of stoppers are pumped in a leading edge of a cement slurry down an annulus between the casing and the wellbore to the tool where the stoppers engage the holes to hold the cement slurry in the annulus until the cement slurry hardens.

33 Claims, 7 Drawing Sheets

U.S. PATENT DOCUMENTS

| | | | | |
|---|---|---|---|---|
| 5,297,634 | A | 3/1994 | Loughlin | 166/387 |
| 5,494,107 | A | 2/1996 | Bode | 166/285 |
| 5,507,345 | A | 4/1996 | Wehunt, Jr. et al. | 166/285 |
| 5,571,281 | A | 11/1996 | Allen | 366/2 |
| 5,890,538 | A | 4/1999 | Beirute et al. | 166/285 |
| 6,098,710 | A | 8/2000 | Rhein-Knudsen et al. | 166/285 |
| 6,244,342 | B1 | 6/2001 | Sullaway et al. | 166/285 |
| 6,311,775 | B1 | 11/2001 | Allamon et al. | 166/285 |
| 6,467,546 | B1 | 10/2002 | Allamon et al. | 166/381 |
| 6,481,494 | B1 | 11/2002 | Dusterhoft et al. | 166/51 |
| 6,484,804 | B1 | 11/2002 | Allamon et al. | 166/291 |
| 6,540,022 | B1 | 4/2003 | Dusterhoft et al. | 166/278 |
| 6,802,374 | B1 * | 10/2004 | Edgar et al. | 166/285 |
| 2003/0072208 | A1 | 4/2003 | Rondeau et al. | 366/16 |

FOREIGN PATENT DOCUMENTS

| | | |
|---|---|---|
| GB | 2 327 442 | 10/2000 |
| GB | 2 348 828 | 10/2000 |
| RU | 1 542 143 | 12/1994 |
| RU | 2 086 752 | 8/1997 |
| SU | 571584 | 9/1977 |

OTHER PUBLICATIONS

SPE 29470 entitled "Monitoring Circulatable Hole with Real-Time Correction: Case Histories" by James E. Griffith, dated 1995.

IADC/SPE 35081 entitled "Drill-Cutting Removal in a Horizontal Wellbore For Cementing" by Krishna M. Ravi, dated 1996.

SPE/IADC 79907 entitled "Advances in Tieback Cementing" by Douglas P. MacBachern et al., dated 2003.

SPE 87197 entitled "Reverse Circulation of Primary Cementing Jobs—Evaluation and Case History" by J. Davies, et al., dated Mar. 2, 2004.

Foreign Communication from a related counterpart application dated Nov. 11, 2004.

* cited by examiner

REVERSE CIRCULATION CEMENTING PROCESS

BACKGROUND

This invention relates to processes and systems for cementing casing in a wellbore. The invention more particularly relates to a reverse circulation process wherein cement is pumped down the annulus between the casing and the wellbore and held in place while the cement hardens.

Present cementing processes typically pump a cement slurry down the inside of the casing, out the casing shoe, and up the annulus. Rubber plugs are displaced down the casing behind the slurry to prevent the slurry from depositing inside the casing. Because the cement must travel all the way to the bottom of the casing, to the shoe, and then back up the casing-by-bore annulus, expensive cement retarders are mixed with the cement slurry to ensure the cement does not set prematurely. The long trip also makes for long pump times.

Cement slurries are relatively dense and heavy fluids. To lift the slurry above the casing shoe in the annulus, high-pressure pumping equipment must be used to pressurize the casing. The high pressure drives the cement slurry and wiper plug down the casing and out through the casing shoe into the annulus. High pressure within the casing may cause fractures and other damage to the casing. Further, the high pressure generated in the annulus in the bottom of the bore hole can be sufficient to drive the cement slurry into the formation resulting in formation breakdown.

Alternatively, a reverse circulation method has been used where the cement slurry is pumped down the casing-by-bore annulus. The slurry is displaced down the annulus until the leading edge of the slurry volume is just inside the casing shoe. The leading edge of the slurry must be monitored to determine when it arrives at the casing shoe. Logging tools and tagged fluids (by density and/or radioactive sources) have been used monitor the position of the leading edge of the cement slurry. If significant volumes of the cement slurry enters the casing shoe, clean-out operations must be conducted to insure that cement inside the casing has not covered targeted production zones. Position information provided by tagged fluids is typically available to the operator only after a considerable delay. Thus, even with tagged fluids, the operator is unable to stop the flow of the cement slurry into the casing through the casing shoe until a significant volume of cement has entered the casing. Imprecise monitoring of the position of the leading edge of the cement slurry can result in a column of cement in the casing 100 feet to 500 feet long. This unwanted cement must then be drilled out of the casing at a significant cost.

SUMMARY

The invention provides a method of cementing a casing in a wellbore, the method comprising: positioning a tool at a lower end of the casing, wherein the tool comprises a plurality of holes, wherein the total cross-sectional area of the plurality of holes is greater than the cross-sectional area of the inside of the casing; introducing a plurality of stoppers into a suspension fluid in an annulus between the casing and the wellbore; pumping the plurality of stoppers to the positioned tool; pumping a cement slurry into the annulus until a leading edge of the cement slurry is pumped to the positioned tool; stopping the pumping a cement slurry when the leading edge is pumped to the position tool; and holding the cement slurry in the annulus until the cement slurry hardens.

According to another aspect of the invention, there is provided a method for determining a volume of an annulus between a well casing and a wellbore, the method comprising: positioning a tool at a lower end of the casing, wherein the tool comprises a plurality of holes; introducing a plurality of stoppers into a suspension fluid in an annulus between the casing and the wellbore; pumping the plurality of stoppers to the positioned tool; monitoring a flow rate of fluid through the wellbore during the pumping and the duration of the pumping; stopping the pumping when a change in flow rate is observed; and calculating the volume of fluid pumped during the pumping the plurality of stoppers.

According to still another aspect of the invention, there is provided a system for cementing a well casing in a wellbore, the system comprising: a well casing having upper and lower sections; a tool connected to the lower section of the well casing, the tool comprising a plurality of holes, wherein the total cross-sectional area of the plurality of holes is greater than the cross-sectional area of the casing; a casing shoe connected to the tool; and a plurality of stoppers, wherein each stopper is larger than each hole of the plurality of holes, and wherein the stoppers of the plurality of stoppers are engageable with the holes of the plurality of holes.

A further embodiment of the invention provides a method of cementing a primary casing in a wellbore, the method comprising: setting a surface casing in the wellbore; running the primary casing into the wellbore; and pumping a cement slurry into an annulus defined between the surface casing and the primary casing with at least one centrifugal pump at a pressure between 40 psi and 160 psi.

The objects, features, and advantages of the present invention will be readily apparent to those skilled in the art upon a reading of the description of the preferred embodiment which follows.

BRIEF DESCRIPTION OF THE FIGURES

The present invention is better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefor not to be considered limiting of its scope, as the invention may admit to other equally effective embodiments.

DETAILED DESCRIPTION OF THE INVENTION

Figure 1:
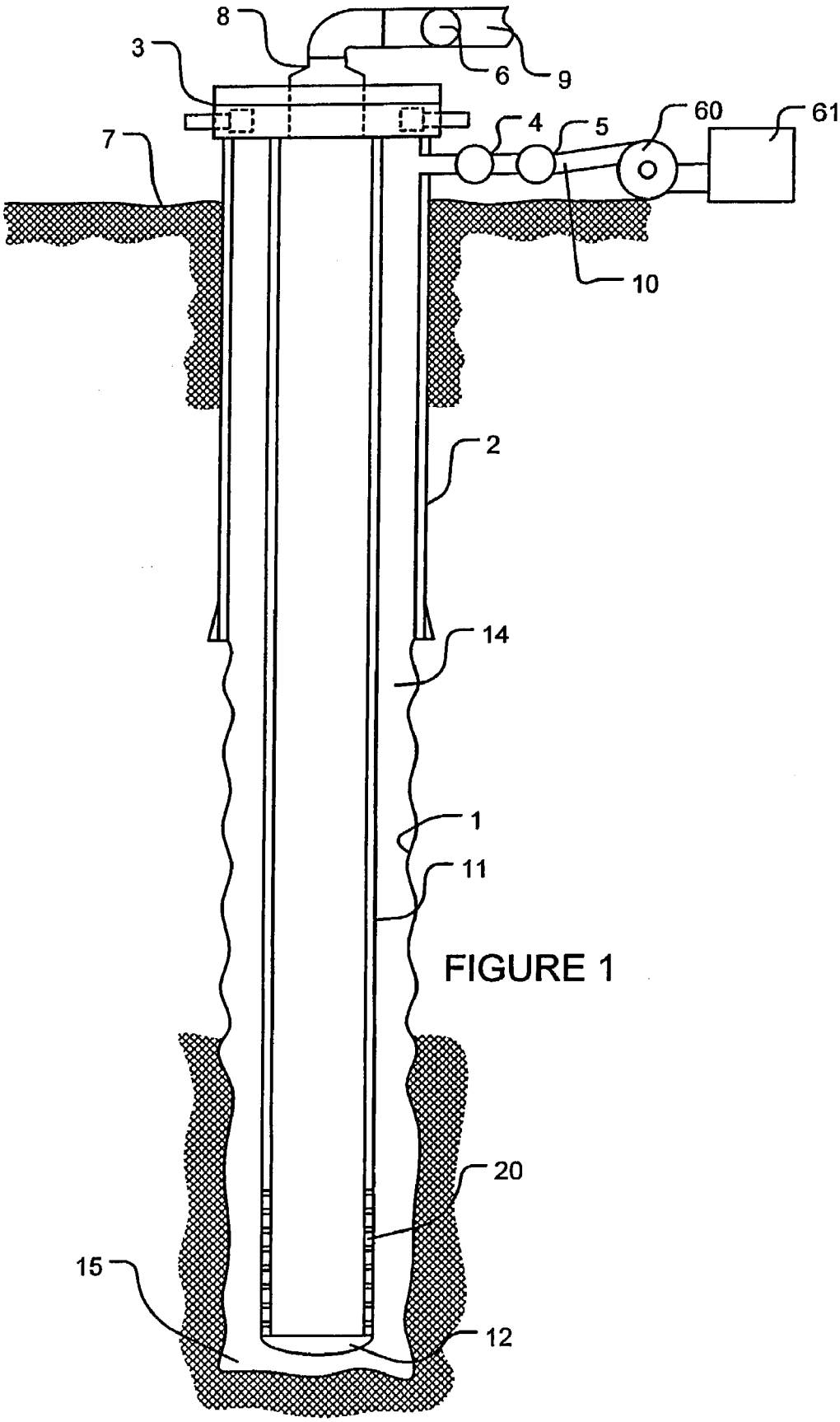
FIG. 1 is a side view of a primary casing suspended in a wellbore, wherein a stopper catch tool is attached to the lower end of the primary casing.

Referring to FIG. 1, a cross-sectional, side view of a wellbore 1 and primary casing 11 of the present invention is shown. The wellbore 1 is drilled below the earth's surface 7. A surface casing 2 is inserted a short distance below the surface 7 into the wellbore 1. A blow out preventer 3 is attached to the top of the surface casing 2 which extends slightly above the surface 7. A swage nipple 8 is attached to the top of the blow out preventer 3 or may be attached to the primary casing 11. A return line 9 extends from the top of the swag nipple 8, and a casing flow meter 6 monitors the flow rate in the return line 9. A pump line 10 is attached to the surface casing 2 below the blow out preventer 3 to communicate fluid to the inside of the surface casing 2. The pump line 10 has an annulus pressure meter 4 and an annulus flow meter 5. Primary casing 11 is suspended in the wellbore 1 below the blow out preventer 3. A stopper catch tool 20 is attached to the lower end of the primary casing 11 and a casing shoe 12 is attached to the lower end of the stopper catch tool 20.

Figure 2:
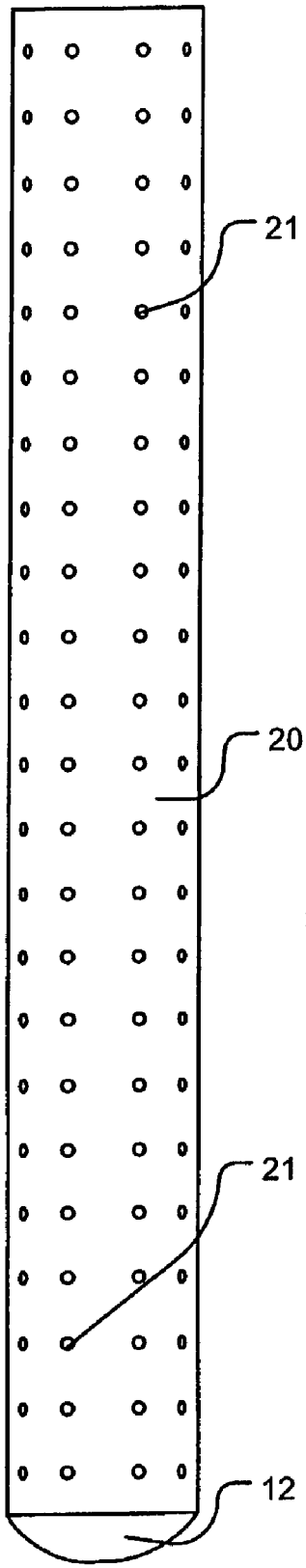
FIG. 2 is a side view of a stopper catch tool having stopper holes and a casing shoe.

Referring to FIG. 2, a side view of the stopper catch tool 20 of the present invention is shown. In this embodiment, the stopper catch tool 20 is a cylindrical pipe section having a plurality of stopper holes 21 extending from the outside diameter surface to the inside diameter surface. The number and pattern of the stopper holes 21 may assume a variety of forms. In the illustrated embodiment, the stopper holes 21 are positioned linearly in the longitudinal and transverse directions. Further, the sizes of the stopper holes 21 may be different depending on the particular application. In one embodiment, the total sum of the cross-sectional areas of the stopper holes 21 is greater than the transverse cross-sectional area of the inside diameter of the primary casing 11. This ensures that the stopper catch tool 20 does not significantly impede the flow of circulation fluid through the well. The casing shoe 12 attached to the stopper catch tool 20 may be of any type or style known to persons of skill in the art.

Figure 3:
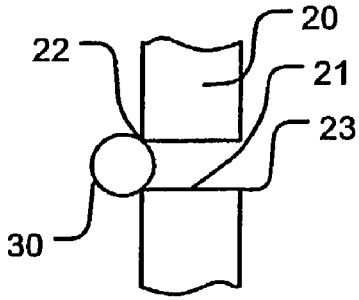
FIG. 3 is a cross-sectional side view of a cylindrical stopper hole in a stopper catch tool, wherein a spherical stopper is engaged with the stopper hole.

FIGS. 3–6 illustrate cross-sectional side views of stopper holes 21 and stoppers 30. In FIG. 3, the stopper 30 is a sphere and the stopper hole 21 has a cylindrical shape. The outside diameter of the stopper 30 is greater than the inside diameter of the stopper hole 21. Thus, when the stopper 30 is suspended in a fluid passing through the stopper hole 21, the stopper 30 will be drawn toward the stopper hole 21 and eventually engage the outside orifice 22 of the stopper hole 21. Because the stopper 30 is too large to fit through the stopper hole 21, the higher relative fluid pressure outside the stopper catch tool 20 will hold the stopper 30 against the outside orifice 22 so as to plug the stopper hole 21.

Figure 4:
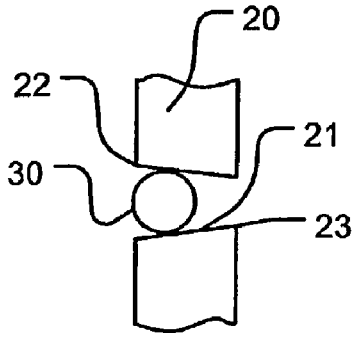
FIG. 4 is a cross-sectional side view of a conical stopper hole, wherein a spherical stopper is engaged in the stopper hole.

A spherical stopper 30 is also shown in FIG. 4. The stopper hole 21 of this embodiment, however, has a conical shape. The outside orifice 22 has a larger diameter than the inside orifice 23. The outside diameter of the stopper 30 is smaller than the diameter of the outside orifice 22, but larger than the diameter of the inside orifice 23. This enables the stopper 30 to pass into the stopper hole 21 where it becomes lodged somewhere between the outside orifice 22 and the inside orifice 23. Because the stopper 30 is suspended in a fluid flowing through the stopper hole 21, the stopper is drawn toward the stopper hole 21 where it eventually becomes plugged in the stopper hole 21. Because the stopper 30 becomes lodged inside the stopper hole 21, it is less likely to disengage from the stopper hole 21 even when fluid pressure is equalized across the stopper hole 21.

Figure 5:
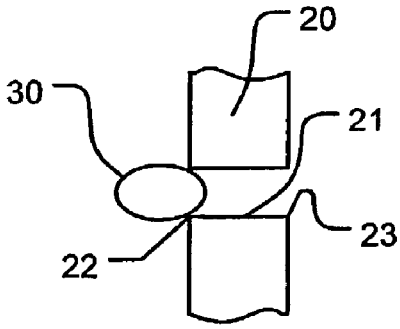
FIG. 5 is a cross-sectional side view of a cylindrical stopper hole in a stopper catch tool, wherein an elliptical stopper is engaged with the stopper hole.

FIG. 5 illustrates an embodiment of the invention wherein the stopper 30 has an elliptical shape in cross-section. The stopper hole 21 has a cylindrical shape so that the diameters of the outside orifice 22 and the inside orifice 23 are the same. While the stopper 30 is elliptical in the longitudinal direction, it is circular in the transverse direction. The largest diameter of the circular transverse cross-section is larger than the diameter of the outside orifice 22. Thus, when the stopper 30 is suspended in a fluid flowing through the stopper hole 21, the stopper 30 becomes lodged at the outside orifice 22 as shown in FIG. 5.

Figure 6:
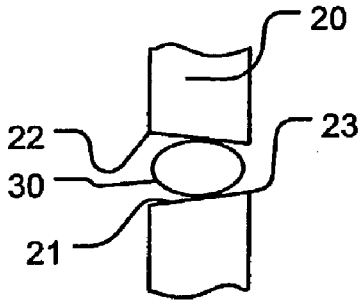
FIG. 6 is a cross-sectional side view of a conical stopper hole in a stopper catch tool, wherein an elliptical stopper is engaged in the stopper hole.

Referring to FIG. 6, a cross-sectional side view of the stopper 30 and stopper hole 21 is shown in the stopper catch tool 20. Again, the stopper 30 has an elliptical shape in the longitudinal direction and a circular shape in the transverse direction. The stopper hole 21 has a conical shape so that the diameter of the outside orifice 22 is larger than the diameter of the inside orifice 23. The diameter of the transverse circular cross-section of the stopper 30 is smaller than the diameter of the outside orifice 22 but larger than the diameter of the inside orifice 23. Thus, when the stopper 30 is drawn into the stopper hole 21 as suspension fluid flows through the stopper hole 21, the stopper 30 becomes lodged inside the stopper hole 21 as shown in FIG. 6. Because the stopper 30 becomes lodged inside the stopper hole 21, it is less likely to disengage from the stopper hole 21 even when fluid pressure is equalized across the stopper hole 21.

The stopper catch tool 20 is attached to the bottom of the primary casing 11 and may be centralized by rigid centralization blades (not shown). In one embodiment of the invention, the stopper catch tool 20 is made of the same material as the primary casing 11, with the same outside diameter and inside diameter dimensions. Alternative materials such as steel, composites, iron, plastic, and aluminum may also be used for the stopper catch tool 20 so long as the construction is rugged to endure the run-in procedure and environmental conditions of the wellbore. Stopper holes 21 are drilled through the side of the stopper catch tool 20 which allow the fluid to flow from primary annulus 14, through the stopper catch tool 20, and into the primary casing 11. The stopper holes 21 may be dispersed in any pattern or spacing around the stopper catch tool 20. In one embodiment of the invention, sixty-three (63) stopper holes 21 are drilled over an eighteen (18) inch length of the stopper catch tool 20. In an alternative embodiment, two hundred twenty-five (225) stopper holes 21 are drilled over a twenty-four (24) inch length of the stopper catch tool 20. In both of these embodiments, the stopper holes are 0.3 inches in diameter. In most embodiments of the invention, the number of stopper holes 21 is related to the cross-sectional, inside area of the primary casing 11 to make the cumulative area of the stopper holes 21 greater than the cross-sectional area of the inside of the primary casing 11. If the density of the stopper holes 21 is too great, the structural integrity of the stopper catch tool 20 may be jeopardized. However, if the stopper holes 21 are too dispersed, the stopper catch tool 20 may have an undesirably high shoe joint volume.

According to one embodiment of the invention, the stoppers 30 have an outside diameter of 0.375 inches so that the stoppers 30 could clear the annular clearance of the casing collar and wellbore (6.33 inches×5 inches for example). However, in most embodiments, the stopper 30 outside diameter is large enough to bridge the stopper holes 21 in the stopper catch tool 20. The composition of the stoppers 30 may be of sufficient structural integrity so that downhole pressures and temperatures do not cause the stoppers 30 to deform and pass through the stopper holes 21 in the stopper catch tool 20. The stoppers 30 may be constructed of plastic, rubber, steel, neoprene plastics, rubber coated steel, or any other material known to persons of skill.

One methodology of the present invention is to install a stopper catch tool to a casing string between the end of the casing and a casing shoe. The casing is run into the well's total depth and the casing-by-hole-annulus is isolated with common well blow out prevention equipment. The well is prepared for cementing by circulating a conventional mud slurry in the conventional direction down through the casing and up the annulus for at least one hole volume or until the annulus fluid is sufficiently clean. Pumping lines or piping are connected to both sides of the casing hanger or wellhead. Return lines or piping is installed to the top of the casing to a return tank or pit. A flow meter is installed in the return line. The cement slurry is then pumped down the annulus at a predetermined rate, for example, 1 bb/min–15 bb/min. As used in this disclosure, the word "pumping" broadly means to flow the slurry into the annulus. It is to be understood that very little pressure must be applied behind the cement slurry to "pump" it down the annulus because gravity pulls the relatively dense cement slurry down the annulus. A set of stoppers are introduced in the leading edge of the cement slurry. Depending on the relative density of the stoppers compared to the slurry, a wiper ring may be pumped behind the stoppers to ensure they remain at the leading edge of the slurry as they are pumped down the annulus. The return flow from the casing is monitored. Once the stoppers land and seal on the stopper holes in the stopper catch tool, the return flow rate will slow as indicated by the flow meter. The casing is landed in the casing hanger or wellhead and the cement job is complete. This process is described in more detail with reference to the Figures below.

Since the reverse circulation process of the present invention pumps the cement slurry directly down the annulus, rather than pumping it up the annulus from the casing shoe, the invention does not require the need for incremental work to lift the dense cement slurry in the casing-by-hole annulus by high-pressure surface pumping equipment. With this process, only a pump is used to transfer the cement slurry from a slurry mixing or holding device to the well. A low-pressure pump, such as a centrifugal pump, may be used for this purpose. Because low-pressure pumps and flow lines may be used with the present invention, safety is inherently built into the system. It is not necessary to certify that the pumps and flow lines will operate safely at relatively higher pressures.

As shown in FIG. 1, a centrifugal pump 60 may be used to pump cement slurry from a slurry mixing device 61 into the primary annulus 14. One or more 6×4 centrifugal pumps (six inch suction×four inch discharge), which operate between about 40 psi and about 80 psi, may be used to pump the cement slurry from the slurry mixing device 61 to the well. Two or more centrifugal pumps may be connected in series to produce a pump pressure of about 160 psi or more. This pressure may be required as the leading edge of the cement slurry is pumped into the primary annulus 14. The pressure may then be reduced as more of the cement slurry enters the primary annulus 14. Gravity acting on the relatively heavy cement slurry tends to pull the cement slurry down the primary annulus 14 so that less pump pressure is needed.

Figure 7:
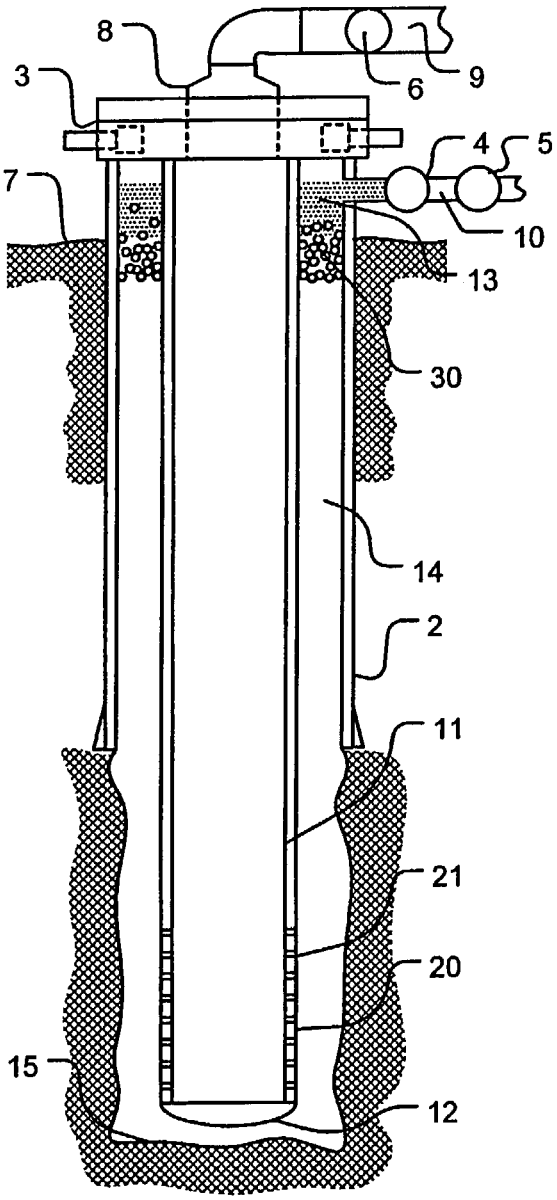
FIG. 7 is a cross-sectional side view of a primary casing with a stopper catch tool at its lower end, wherein stoppers and a cement slurry are being pumped from a pump line into the annulus.

Referring to FIG. 7, a side view of wellbore 1 is shown. The equipment shown here is similar to that identified with reference to FIG. 1. FIG. 7 illustrates a plurality of stoppers 30 which have been introduced into pump line 10 ahead of a cement slurry 13. The stoppers 30 and cement slurry 13 flow from the pump line 10 into the primary annulus 14 defined between the primary casing 11 and the surface casing 2. The stoppers 30 and cement slurry 13 flow down the primary annulus 14 from the pump line 10 toward the stopper catch tool 20 at the bottom of the primary casing 11. Circulation fluid returns through the stopper holes 21 of the stopper catch tool 20, up the primary casing 11, and out through the return line 9. The flow rate of the circulation fluid through the return line 9 is monitored on casing flow meter 6.

Figure 8:
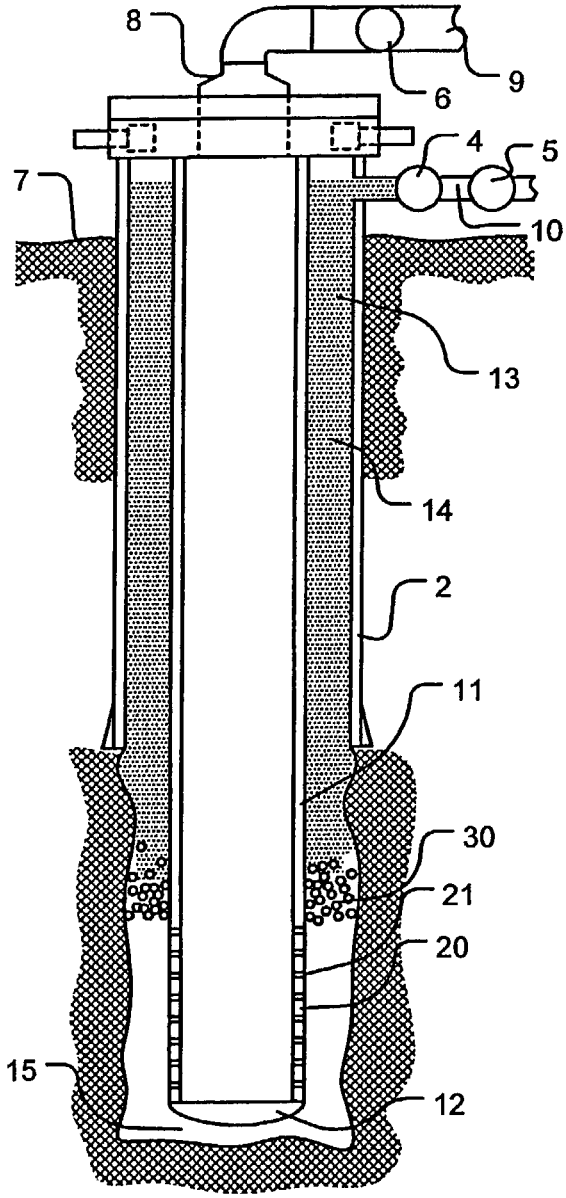
FIG. 8 is a side view of the casing and wellbore shown in FIG. 7, wherein the stoppers and cement slurry are pumped down a significant portion of the annulus.

FIG. 8 is a side view of the wellbore 1 shown in FIG. 7. In this figure, the stoppers 30 and cement slurry 13 have progressed down the primary annulus 14 until the stoppers 30 are immediately above the stopper catch tool 20. As the cement slurry 13 flows down the primary annulus 14, circulation fluid is drawn through the stopper holes 21 and up through the inside diameter of the primary casing 11. The return fluid is withdrawn from the primary casing 11 by swage nipple 8 and return line 9. Because the stoppers 30 have yet to engage the stopper holes 21, no change in the flow rate is detected on casing flow meter 6.

Figure 9:
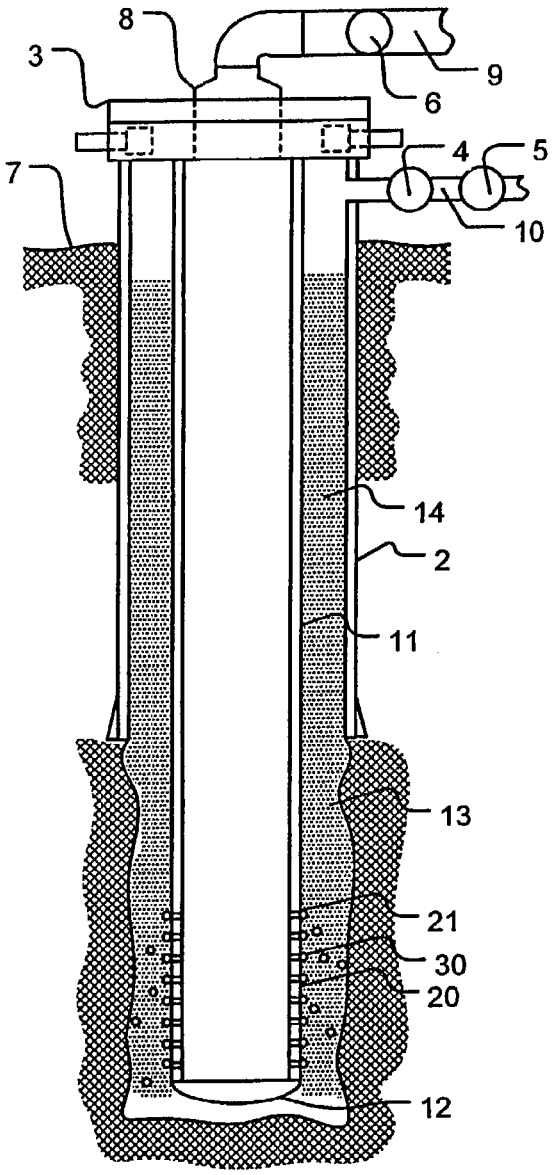
FIG. 9 is a side view of the casing and wellbore shown in FIGS. 7 and 8, wherein the stoppers have been pumped to engage the stopper holes of the stopper catch tool and the cement slurry completely fills the annulus.

Referring to FIG. 9, a side view of the wellbore 1 shown in FIGS. 7 and 8 is illustrated. In this Figure, the stoppers 30 have progressed down the primary annulus 14 to the stopper catch tool 20. As the circulation fluid and/or cement slurry 13 suspending the stoppers 30 is drawn through the stopper holes 21 in the stopper catch tool 20, the stoppers 30 are drawn to the stopper holes 21. Individual stoppers 30 engage individual stopper holes 21. As the stopper holes 21 at the top of the stopper catch tool 20 become engaged or blocked by stoppers 30, circulation fluid and/or cement slurry 13 is then only allowed to flow through the remaining open stopper holes 21 further down the stopper catch tool 20. This flow draws additional stoppers 30 further down the stopper catch tool 20 where they engage the remaining stopper holes 21. This process continues until all or nearly all of the stopper holes 21 have been engaged by stoppers 30. When a significant number of stoppers 30 have engaged stopper holes 21, a decrease in the flow rate of the circulation fluid is observed on the casing flow meter 6. Also, an increase in annulus pressure is observed on the annulus pressure meter 4. By these observations, the operator understands that the cement slurry 13 has reached the bottom of the primary annulus 14. The operator stops the fluid flow into the pump line 10. Further, the primary casing 11 is landed in a surface casing hanger or wellhead and the cement job is completed. In some embodiments of the invention, it is desirable for the stoppers 30 to remain engaged with the stopper holes 21 to hold the cement slurry 13 in the primary annulus 14 until the cement slurry 13 hardens or solidifies. The stopper holes 21 described with reference to FIGS. 4 and 6 are particularly applicable for this purpose. Stopper 30 which are neutrally buoyant in the circulation fluid and/or cement slurry 13 also tend to remain engaged with the stopper holes 21 which the cement slurry 13 solidifies.

According to an alternative methodology of the invention, the stoppers 30 are used to first determine an annulus dynamic volume (ADV) before the cement slurry 13 is pumped into the primary annulus 14. After the primary annulus 14 is sufficiently cleaned, stoppers 30 are introduced into the pump line 10 where they flow into the primary annulus 14. Circulation fluid, rather than cement slurry, is pumped down the primary annulus 14 behind the stoppers 30. The circulation fluid is reverse-circulated down the primary annulus 14 and up the inside diameter of the primary casing 11. From the time the stoppers 30 are introduced at the pump line 10, until the stoppers 30 reach the stopper catch tool 20, the annulus flow meter 5 and/or casing flow meter 6 are monitored to determine the ADV. When the stoppers 30 become engaged with the stopper holes 21 of the stopper catch tool 20, they plug some or all of the stopper holes 21 of the stopper catch tool 20 so as to alert the operator that the stoppers 30 have reached the stopper catch tool 20. Once the operator has determined the ADV, it is no longer desirable for the stoppers 30 to engage the stopper holes 21 of the stopper catch tool 20. The operator then stops the fluid flow and balances the pressure between the inside of the stopper catch tool 20 and the primary annulus 14 to stagnate the fluid in the vicinity of the stopper catch tool 20. In this embodiment of the invention, the density of the stoppers 30 is slightly greater than that of the circulation fluid. Because the stoppers 30 are slightly more dense than the fluid, the stoppers 30 disengage from the stopper holes 21 and sink in the stagnated circulation fluid to the bottom of the rate hole 15 (see FIG. 1). With the ADV determined and the stoppers 30 cleared from the stopper catch tool 20, the operator then mixes a volume of cement slurry 13 equal to or slightly greater than the ADV. The cement slurry 13 is then introduced into pump line 10 as circulating fluid is drawn ahead of the cement slurry 13 down primary annulus 14, through stopper holes 21 and up the inside diameter of the primary casing 11, and out return line 9. When the predetermined volume of cement slurry 13 has been pumped into the primary annulus 14, pumping operations are ceased. In one embodiment of the invention, a sliding sleeve valve is then closed proximate the stopper catch tool 20 to hold the cement slurry 13 in the primary annulus 14. The primary casing 11 is landed in the surface casing hanger or wellhead and the cement job is completed.

Depending on the embodiment of the invention, more stoppers 30 than the number of stopper holes 21 in the stopper catch tool 20 may be used. In one embodiment of the invention, the number of stoppers 30 in the cement slurry 13 compared to the number of stopper holes 21 in the stopper catch tool 20 is about 150%. This excess number of stoppers 30 relative to the number of stopper holes 21 insures a sufficient number of stoppers 30 close the stopper holes 21 in the stopper catch tool 20 at approximately the same time. This may be helpful in embodiments where the stoppers 30 are introduced at the leading edge of a cement slurry 13 and it is intended for the stoppers 30 to hold the cement slurry 13 in the primary annulus 14 without allowing the cement slurry 13 to enter the interior of the primary casing 11.

In other embodiments of the invention a much smaller number of stoppers 30 (50% of the number of stopper holes 21) are used to stop or plug only a portion of the stopper holes 21. When only a portion of the stopper holes 21 are stopped or plugged, the operator may still observe a change in the fluid flow through the wellbore or a change in the annulus pressure to know that the stoppers 30 have reached the stopper catch tool 20. However, the stopper catch tool 20 remains open through the stopper holes 21 which were not stopped or plugged by stoppers 30. A smaller number of stoppers 30 may be applicable where it is desirable to calculate the ADV before the cement slurry 13 is pumped into the primary annulus 14. Because only a portion of the stopper holes 21 are plugged, it may be unnecessary to allow the stoppers 30 to disengage from the stopper holes 21 before the cement slurry 13 is pumped into the primary annulus 14.

Figure 15A:
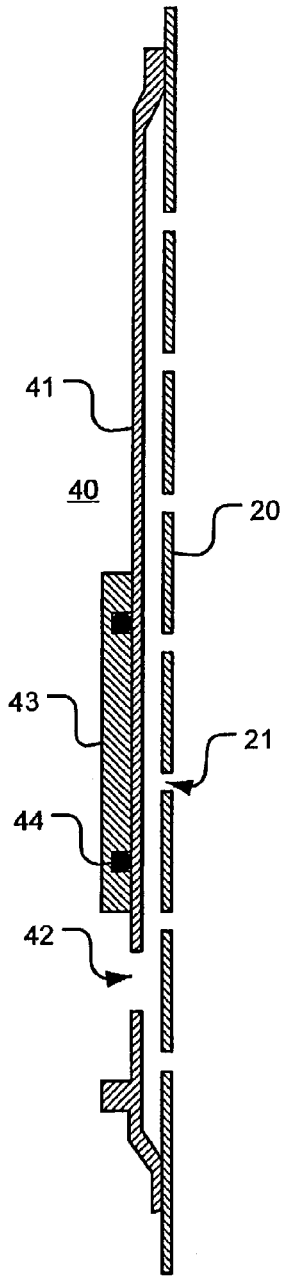
FIG. 15A is a cross-sectional side view of a valve used to close fluid flow through a stopper catch tool, wherein the valve is in an open configuration.
Figure 15B:
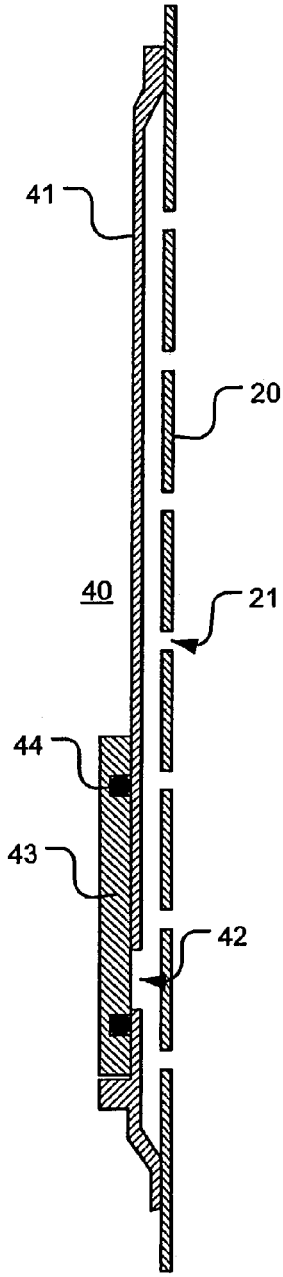
FIG. 15B is a cross-sectional side view of the valve shown in FIG. 15A, wherein the valve is shown in a closed configuration.

As noted above, some embodiments of the invention incorporate a final shut off device such as a sliding sleeve valve or ball valve to permanently cover the stopper holes 21 in the stopper catch tool 20. Referring to FIGS. 15A and 15B, a sliding sleeve valve 40 is illustrated for closing the stopper catch tool 20 near the end of the cement operation. The valve 40 is shown in an open configuration in FIG. 15A and a closed configuration in FIG. 15B. The valve 40 has an isolation sleeve 41 which attaches to the stopper catch tool 20 above and below the stopper holes 21. The isolation sleeve 41 has a port 42 which allows fluid communication through the isolation sleeve 41. A sliding sleeve 43 is concentrically mounted on the isolation sleeve 41. In the open configuration, the sliding sleeve 43 is displaced from the port 42 to allow fluid communication through the port 42. In the closed configuration, the sliding sleeve 43 covers the port 42 to completely seal the valve 40. Seals 44 are positioned in recesses of the sliding sleeve 43 to insure the integrity of the valve 40. In different embodiments of the invention, the isolation sleeve 41 may be either on the inside of the stopper catch tool 20 or on the outside. Also, the sliding sleeve 43 may be between the isolation sleeve 41 and the stopper catch tool 20. The sliding sleeve 43 may be actuated by any means known to persons of skill, for example, pressure actuation, mechanical manipulation, etc. In one embodiment of the invention, the valve 40 is actuated by an increase in fluid pressure in the primary annulus 14 compared to fluid pressure inside the primary casing 11. Thus, during the cementing operation, when the stoppers 30 engage the stopper holes 21, the resulting increase in relative annulus pressure is sufficient to close the valve 40.

Figure 16A:
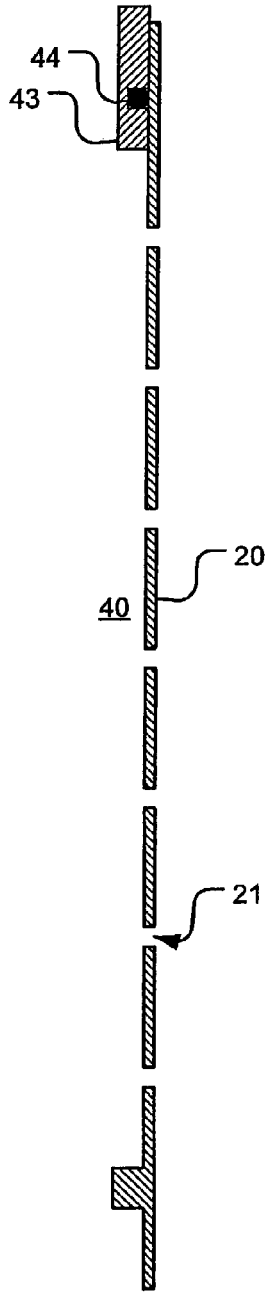
FIG. 16A is a cross-sectional side view of a valve used to close fluid catch tool, wherein the valve is shown in an open configuration.
Figure 16B:
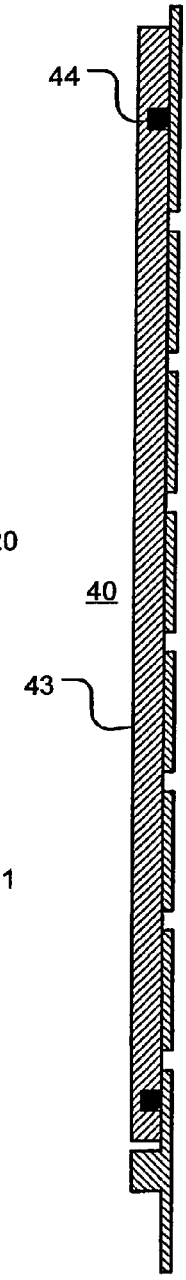
FIG. 16B is a cross-sectional side view of the valve shown in FIG. 16A, wherein the valve is closed.

Referring to FIGS. 16A and 16B, an alternative valve 40 is illustrated in open and closed configurations, respectively. The valve 40 has a sliding sleeve 43 which is concentrically mounted directly to the stopper catch tool 20. The sliding sleeve 43 is long enough to cover all of the stopper holes 21 at the same time. The sliding sleeve 43 has seals 44 in recesses to insure the integrity of the valve 40. The sliding sleeve 43 may be either on the inside or the outside of the stopper catch tool 20. As before, this valve 40 may be opened and closed by any means known to persons of skill, including pressure actuation, mechanical manipulation, etc.

Referring to FIGS. 10–14, an embodiment of the invention is illustrated for cementing a secondary casing 16. A primary casing 11 is already cemented in the wellbore 1. Further, the casing shoe 12 of the primary casing 11 is drilled out and the wellbore 1 is extended below the primary casing 11. The top of the primary casing 11 is modified to allow the pump line 10 to communicate with the inside diameter of the primary casing 11. A casing hanger 17 is positioned in the bottom of the primary casing 11 to receive the secondary casing 16. The secondary casing 16 is run into the wellbore 1 on a pipe string 18 wherein the secondary casing 16 is attached to the pipe string 18 by a release tool 19. Thus, a pipe-by-casing annulus 50 is defined between the pipe string 18 and the primary casing 11. A secondary annulus 51 is defined between the secondary casing 16 and the wellbore 1. The casing hanger 17 has fluid ports therethrough which enable fluid communication between the pipe-by-casing annulus 50 and the secondary annulus 51. The secondary casing 16 has a stopper catch tool 20 attached to its lower end. The stopper catch tool 20 has stopper holes 21 in its side walls and a casing shoe 12 attached to its end.

Figure 10:
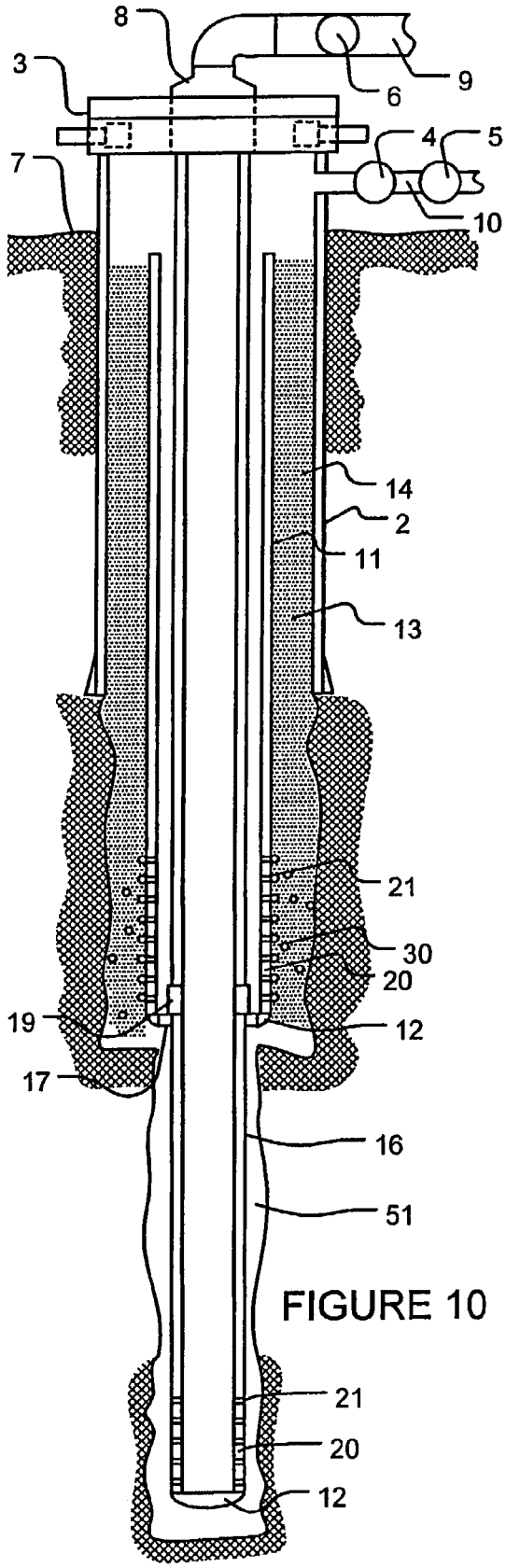
FIG. 10 is a cross-sectional side view of a primary casing cemented in a wellbore and a secondary casing suspended in the wellbore below the primary casing. The secondary casing has a stopper catch tool at its lower end.
Figure 11:
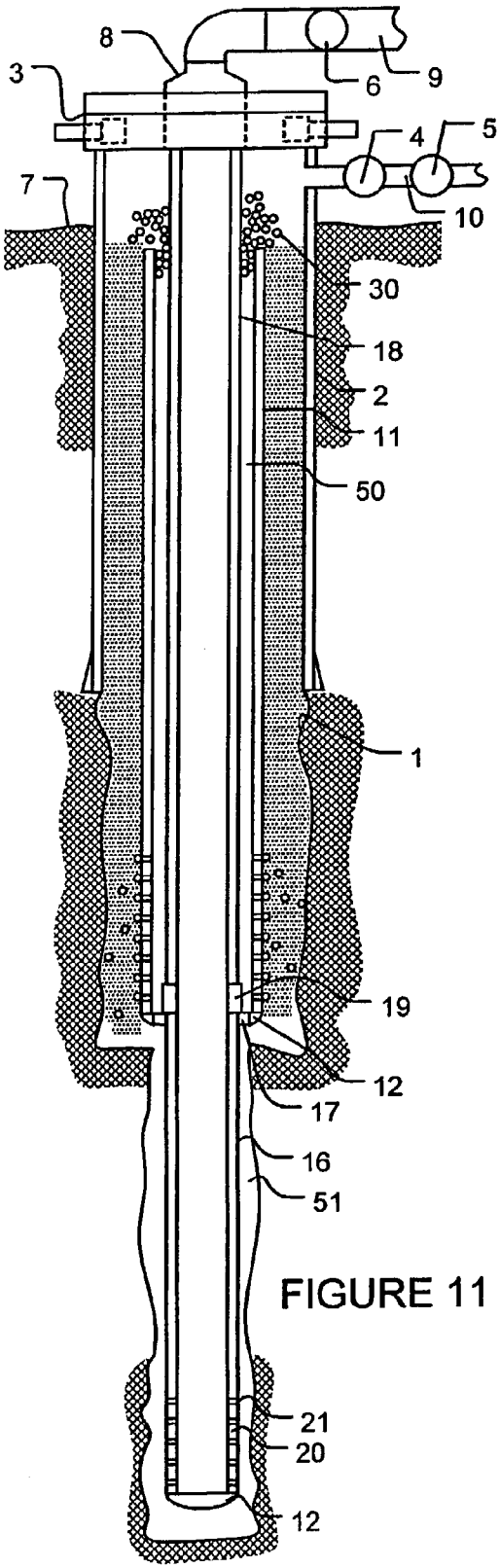
FIG. 11 is a cross-sectional side view of the secondary casing and wellbore shown in FIG. 10, wherein a first set of stoppers have been pumped into the annulus at the pump line.

Referring to FIGS. 11 through 14, a process for cementing the secondary casing 16 illustrated in FIG. 10 is shown. After the secondary annulus 51 is sufficiently clean, stoppers 30 are introduced into the pump line 10. Fluid is reverse circulated down the pipe-by-casing annulus 50, through the casing hanger 17, down the secondary annulus 51, through the stopper holes 21, up the secondary casing 16, up the pipe string 18 and out through the return line 9.

Figure 12:
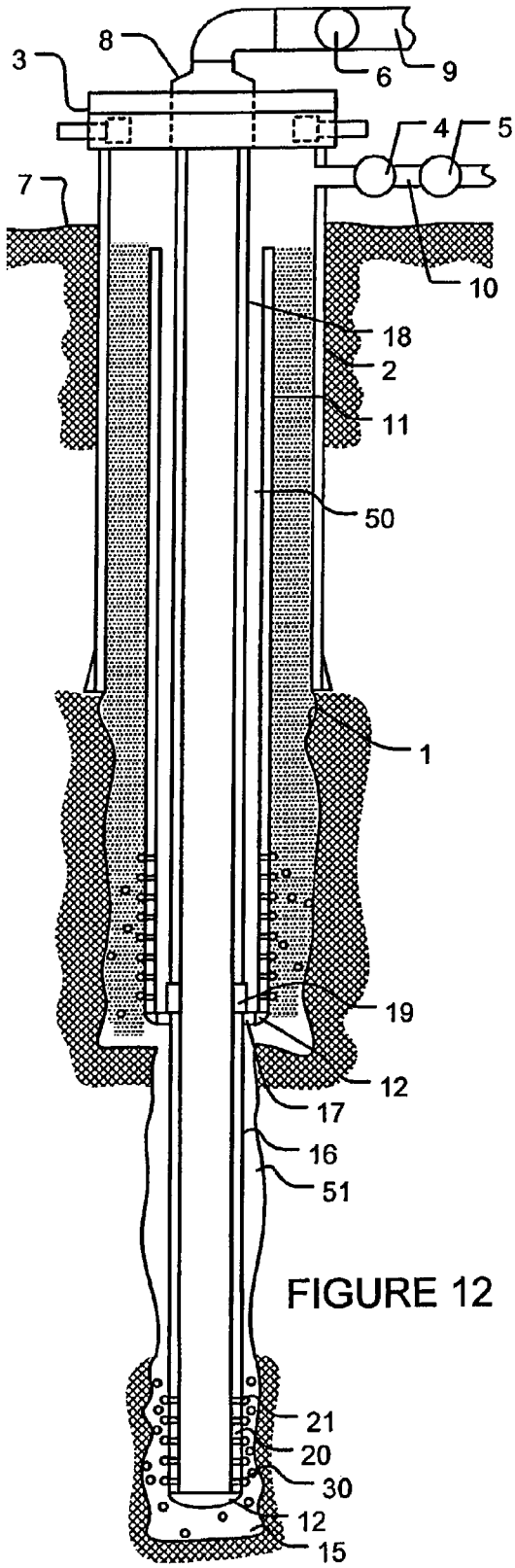
FIG. 12 is a cross-sectional side view of the secondary casing and wellbore shown in FIGS. 10 and 11, wherein the first group of stoppers are illustrated engaged with the stopper holes of the stopper catch tool.
Figure 13:
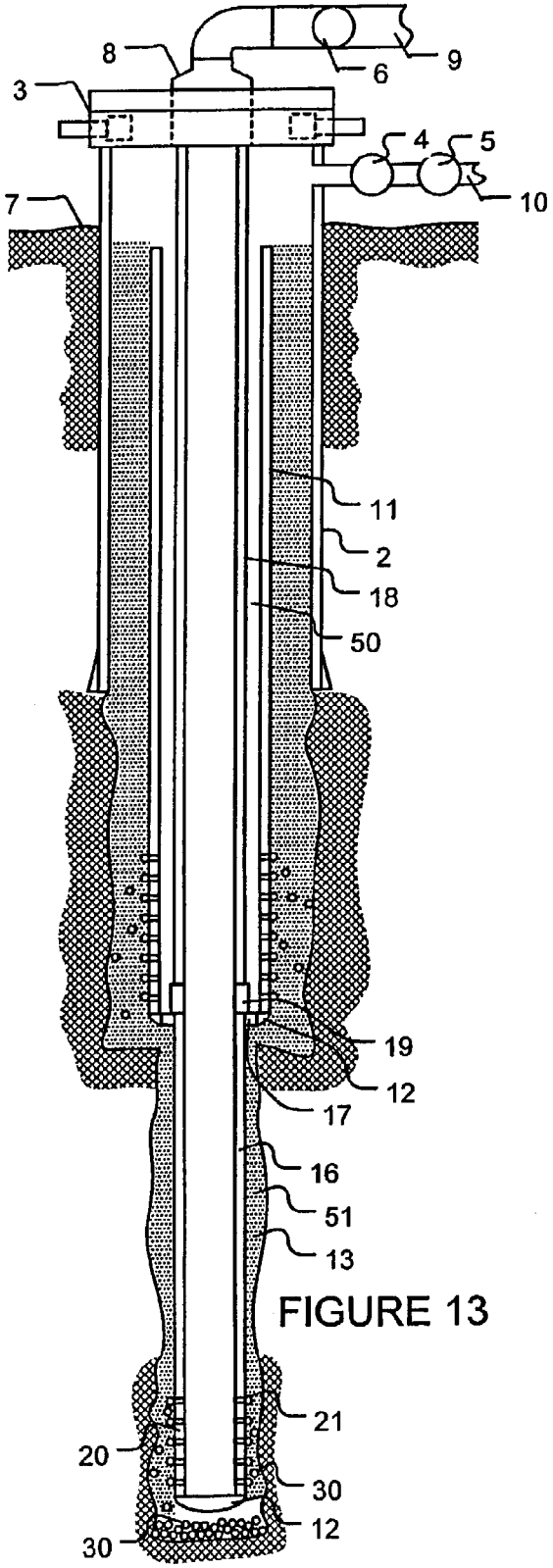
FIG. 13 is a cross-sectional side view of the secondary casing and wellbore shown in FIGS. 10 through 12, wherein the first group of stoppers are illustrated in the bottom of the rat hole, a second group of stoppers are shown engaged with the stopper holes of the stopper catch tool, and a cement slurry fills the secondary annulus.
Figure 14:
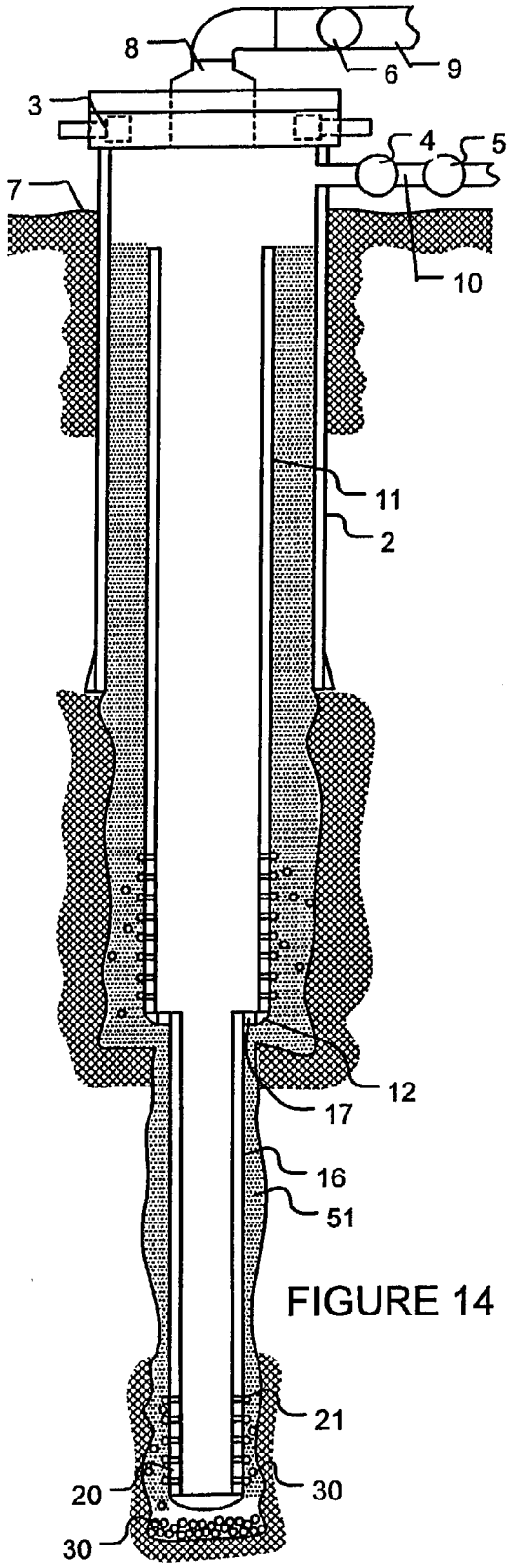
FIG. 14 is a cross-sectional side view the secondary casing and wellbore shown in FIGS. 10 through 13, wherein the cement operation is complete and the release tool and pipe string are withdrawn from the well.

The first step is to determine the ADV of the secondary annulus 51. The ADV is determined by monitoring the annulus flow meter 5 and/or the casing flow meter 6 as the stoppers 30 are pumped from the pump line 10 down the pipe-by-casing annulus 50 until they reach the stopper catch tool 20, as shown in FIG. 12. When a sufficient number of the stoppers 30 engage the stopper holes 21 of the stopper catch tool 20, the operator observes a decline in the flow rate through casing flow meter 6 and/or an increase of annulus pressure on the annulus pressure meter 4. The ADV may then be calculated by determining the fluid volume of the pipe-by-casing annulus 50 from known dimensions. In particular, because the inside diameter and length of the primary casing 11 are known, and the outside diameter and length of the pipe string 18 are known, the volume of the pipe-by-casing annulus 50 is the inside volume of the primary casing 11 minus the outside volume of the pipe string 18. Once the volume of the pipe-by-casing annulus 50 is known, the ADV of the secondary annulus 51 is determined by subtracting the volume of the pipe-by-casing annulus 50 from the total volume required to pump the stoppers 30 from the pump line 10 to the stopper catch tool 20. With the ADV of the secondary annulus 51 known, fluid pressure is balanced between the inside and outside of the stoppers catch tool 20 and the fluid is allowed to stagnate. The stoppers 30 used in this particular embodiment of the invention, are slightly more dense than the circulation fluid. The stoppers 30 disengage from the stopper holes 21 and fall in the stagnated circulation fluid to the bottom of the rat hole 15, as shown in FIG. 13. After the stoppers 30 have had sufficient time to settle in the bottom of the rat hole 15, a second set of stoppers 30 is introduced into the pump line 10 ahead of a cement slurry 13. A volume of cement slurry 13 equal to the ADV for the secondary annulus 51 is pumped behind the second set of stoppers 30 down the pipe-by-casing annulus 50, through the casing hanger 17, and into the secondary annulus 51. When the second set of stoppers 30 reaches the stopper catch tool 20, the entire volume of the cement slurry 13 is pumped into the secondary annulus 51. Of course, a certain volume of circulation fluid is pumped behind the cement slurry 13 to pump the cement slurry 13 down into secondary annulus 51. When the cement placement is complete, the stopper catch tool 20 may be permanently closed, or the stoppers 30 may be allowed to retain the cement slurry 13 in the secondary annulus 51 until the cement slurry 13 has solidified. The secondary casing 16 is hung in the casing hanger 17. The release tool 19 is manipulated to disengage the release tool 19 from the secondary casing 16, and the release tool 19 is withdrawn from the wellbore 1 along with pipe string 18, as shown in FIG. 14.

Because the stoppers 30 of the present invention plug the stopper holes 21 in the stopper catch tool 20 before a significant volume of cement slurry 13 is allowed to enter the casing, the cement operation is complete without significant volumes of cement slurry 13 being inadvertently placed in the casing. Because the inside of the casing remains relatively free of cement, further well operations may be immediately conducted in the well without drilling out undesirable cement in the casing.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of cementing a casing in a wellbore, comprising the steps of:

positioning a tool at a lower end of the casing, wherein the tool has a plurality of holes extending therethrough in direct fluid communication with the annulus, wherein the annulus is defined between the outer surface of the tool and the inner surface of the wellbore;

pumping a plurality of stoppers in a fluid down an annulus between the casing and the wellbore to the tool; and engaging at least one of the holes in the tool with one of the stoppers.

2. The method of claim 1 wherein the step of positioning comprises the steps of:

attaching the tool to the lower end of the casing; and running the casing into the wellbore.

3. The method of claim 1 wherein there are more stoppers than holes in the tool.

4. The method of claim 1 wherein there are fewer stoppers than holes in the tool.

5. The method of claim 1 wherein the fluid is a cement slurry.

6. The method of claim 1 wherein the fluid is a circulating fluid.

7. The method of claim 1 wherein the step of pumping comprises the step of pumping a circulation fluid behind the stoppers until the stoppers are pumped to the tool.

8. The method of claim 1 wherein the step of pumping comprises the step of pumping a cement slurry behind the stoppers until the stoppers are pumped to the tool.

9. The method of claim 8 further comprising the step of maintaining engagement of a portion of the stoppers with the holes in the tool until the cement slurry hardens in the annulus.

10. The method of claim 8 comprising the step of holding the cement slurry in the annulus by closing a valve in the tool.

11. The method of claim 1 further comprising the step of determining an annulus volume of the annulus.

12. The method of claim 11 wherein the step of determining comprises the steps of:

monitoring the flow rate of the fluid during the pumping of the stoppers; and calculating the volume of the fluid pumped during the pumping of the stoppers to the tool.

13. The method of claim 1 wherein the total cross-sectional area of the holes is greater than the cross-sectional area of the inside of the casing.

14. The method of claim 1 further comprising the step of disengaging stoppers from the holes, whereby the stoppers are allowed to sink away from the tool.

15. A method of determining a volume of an annulus between a casing and a wellbore, comprising the steps of:

positioning a tool at a lower end of the casing, wherein the tool has a plurality of holes extending therethrough;

pumping a plurality of stoppers in a fluid down the annulus between the casing and the wellbore to the tool;

monitoring a flow rate of the fluid during the pumping;

detecting a change in the flow rate; and calculating the volume of the fluid pumped during the pumping of the stoppers to the tool.

16. The method of claim 15 wherein the step of positioning comprises the steps of:

attaching the tool to the lower end of the casing; and running the casing into the wellbore.

17. The method of claim 15 wherein there are more stoppers than holes in the tool.

18. The method of claim 15 wherein there are fewer stoppers than holes in the tool.

19. The method of claim 15 wherein the step of pumping comprises the step of pumping a circulation fluid behind the stoppers until the stoppers are pumped to the tool.

20. A system for cementing a casing in a wellbore, comprising:

a tool having a plurality of holes extending therethrough in direct fluid communication with the annulus connected to a tower section of the casing, wherein the annulus is defined between the outer surface of the tool and the inner surface of the wellbore; and a plurality of stoppers engageable with the holes in the tool.

21. The system of claim 20 wherein the total cross-sectional area of the holes is greater than the cross-sectional area of the inside of the casing.

22. The system of claim 20 wherein there are more stoppers than holes in the tool.

23. The system of claim 20 wherein there are fewer stoppers than holes in the tool.

24. The system of claim 20 wherein a portion of the holes are cylindrical.

25. The system of claim 20 wherein a portion of the holes are conical.

26. The system of claim 20 wherein a portion of the stoppers are spherical.

27. The system of claim 20 wherein a portion of the stoppers are elliptical in at least one cross-section.

28. The system of claim 20 further comprising a valve connected to the tool, wherein the valve closes the holes in a closed configuration and opens the holes in an open configuration.

29. A method of cementing a primary casing in a wellbore, comprising the steps of:

setting a surface casing in the wellbore;

running the primary casing into the wellbore; and pumping a cement slurry into an annulus defined between the surface casing and the primary casing with at least one centrifugal pump at a pressure between about 40 psi and about 160 psi.

30. The method of claim 29 wherein the at least one centrifugal pump comprises two centrifugal pumps fluidly connected in series.

31. The method of claim 29 wherein the at least one centrifugal pump comprises a centrifugal pump having a pump intake having a diameter between about 5 inches and about 7 inches and a pump discharge having a diameter between about 3 inches and about 5 inches.

32. The method of claim 29 further comprising the step of reducing the pressure of the pumping as the cement slurry is pumped into the annulus.

33. The method of claim 29 further comprising the step of introducing a plurality of stoppers at a leading edge of the cement slurry.

* * * * *